United States Patent [19]

Gambello

[11] Patent Number: 4,632,256

[45] Date of Patent: Dec. 30, 1986

[54] ADJUSTABLE ARTICLE DISPLAY APPARATUS

[76] Inventor: Vincent J. Gambello, 90 Prospect Ave., Hackensack, N.J. 07601

[21] Appl. No.: 542,595

[22] Filed: Oct. 17, 1983

[51] Int. Cl.[4] ..... A47F 5/08

[52] U.S. Cl. ..... 211/50; 211/175; 248/220.4

[58] Field of Search ..... 211/50, 70.6, 60.1, 211/87, 175; 248/220.4, 221.1, 221.3

[56] References Cited

U.S. PATENT DOCUMENTS 4,322,006 3/1982 Marschak ..... 248/221.1 X 4,509,648 4/1985 Govang et al. ..... 248/220.4 X

*Primary Examiner*—Robert W. Gibson, Jr.

*Attorney, Agent, or Firm*—Edward R. Weingram

[57] ABSTRACT

An adjustable article display apparatus includes a plurality of mounting brackets which are detachably affixed to a carrier board. A plurality of support components are each carried on a mounting bracket in any one of a plurality of lateral positions. The components cooperate to form the adjustable article display apparatus and each component may be releasably locked on its associated mounting bracket in any one of the lateral positions, thereby permitting a precise adjustment. The support components are provided with stops which prevent the accidental removal of the components from the carrier board.

1 Claim, 11 Drawing Figures

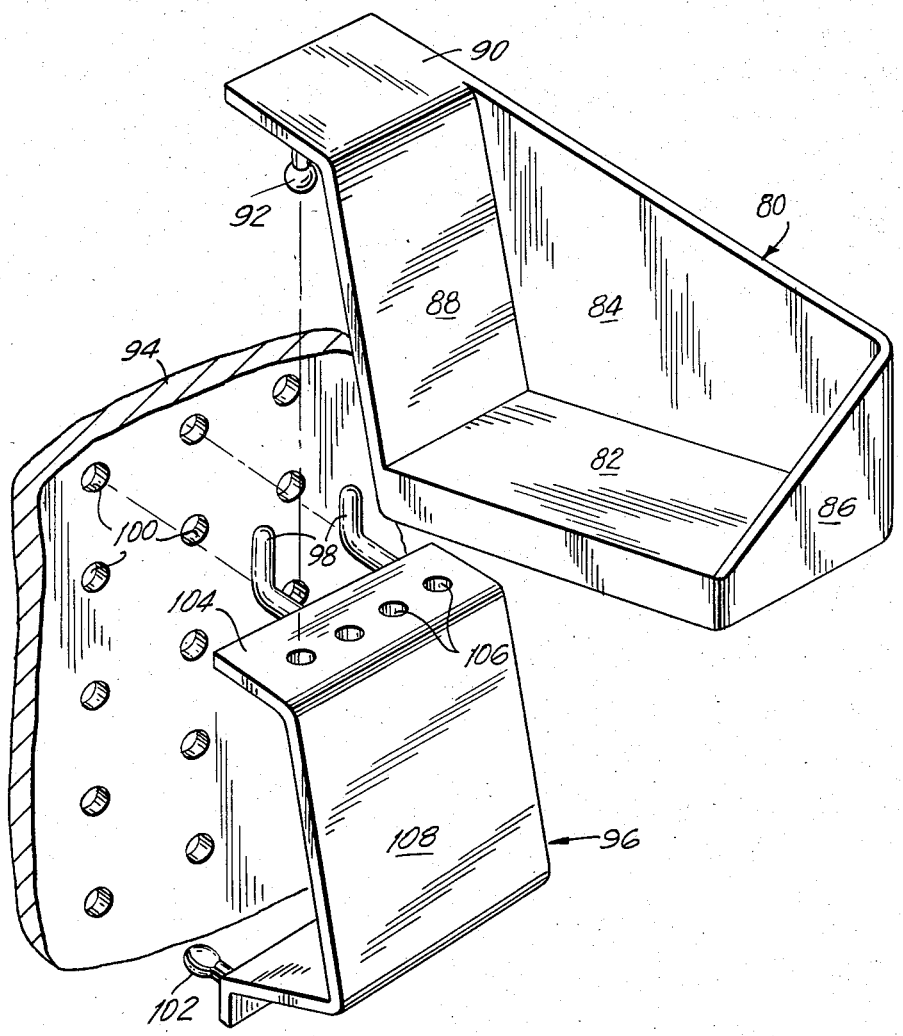
FIG. 5
FIG. 6
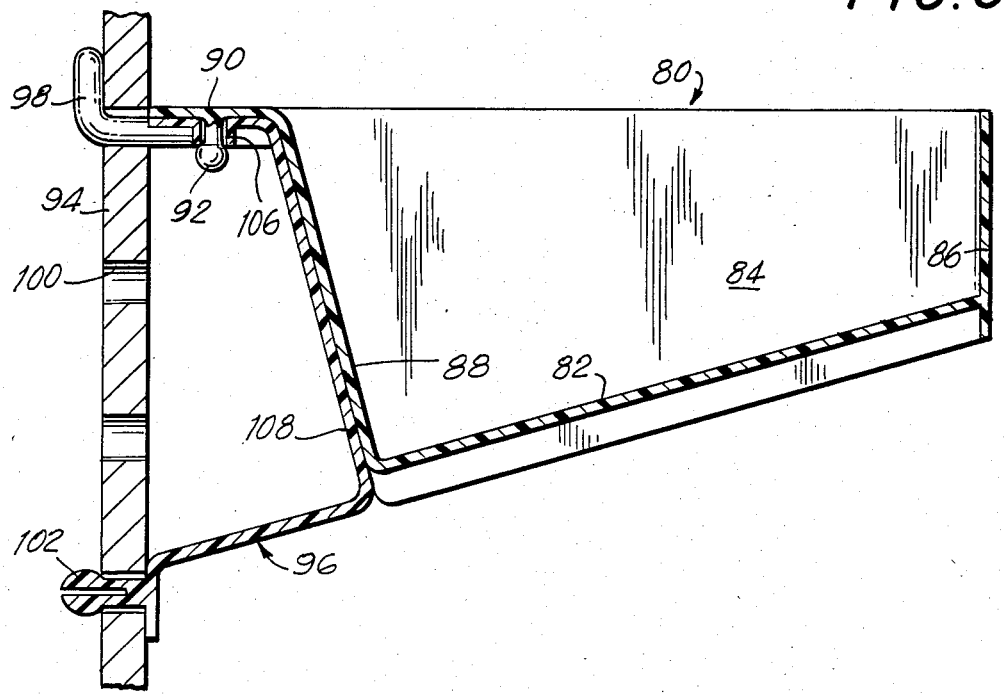

ADJUSTABLE ARTICLE DISPLAY APPARATUS

The invention relates to an adjustable article display apparatus for use with a pegboard or the like.

Apparatus for article display using pegboards are well known in the prior art. These apparatus are often used in merchandising to display a variety of products having varying dimensions. One such apparatus is disclosed in U.S. Pat. No. 2,879,899 issued to Bernard Shenkin for "An Article Supporting and Displaying Device". In the apparatus disclosed there, a plurality of laterally-spaced components or supports are attached to a pegboard to carry groups of cards or card-like objects. These components are held in the small circular openings formed in the pegboard and the distance between adjacent components may be varied by moving the components to a new set of openings on the board. A similar apparatus is disclosed in U.S. Pat. No. 3,501,015 issued to P. E. Behles for "Displayer Device for Packaged Merchandise."

These prior display apparatus incorporate several disadvantages. For example, the adjustment of the relative spacing of the support component, is limited by the location of the holes in the pegboard. As a result, some objects cannot be held for display in these apparatus. These apparatus also do not provide sufficient support over the length of large flexible objects, which then tend to deform and fall out of the support components. In addition, these support components themselves are not as firmly secured to the pegboard as may be desired and may become detached from the pegboard through inadvertence.

Accordingly, it is an object of the present invention to provide an adjustable article display apparatus which clearly displays articles supported therein such as merchandise.

Another object of the invention is to provide an adjustable article display apparatus which permits a more precise lateral adjustment of the support components than do display apparatus of the prior art.

Still another object of the invention is to provide an adjustable article display apparatus in which the individual support components are compatible with accessories so as to accommodate oversized and flexible articles.

A further object of the invention is to provide an adjustable article display apparatus in which the individual support components are firmly secured to the pegboard.

A still further object of the invention is to provide an adjustable article display apparatus which is quickly and easily assembled on a carrier board.

According to the present invention, an adjustable article display apparatus includes a plurality of mounting brackets detachably affixed to a carrier board such as a pegboard. A support component is carried by each of the mounting brackets. The support components cooperate to hold the articles to be displayed by supporting such articles at or about their ends. Each support component is releasably locked on a mounting bracket in any one of a plurality of lateral positions so as to permit a precise adjustment of the relative lateral spacing of the support components. In addition, the support components are provided with stops which prevent the accidental removal of the components from the carrier board.

The invention further includes accessories such as bridges and easels which may be used with the support components to accommodate oversized and flexible articles.

In the accompanying drawings to which reference is made in the instant specification and in which like parts are indicated by like reference characters in the various views:

FIG. 5 is an exploded view of an alternate embodiment of the invention showing a right-end support component and its associated mounting bracket;

FIG. 6 is a sectional side elevation of the right-end support component and its associated mounting bracket of FIG. 5;

Figure 1:
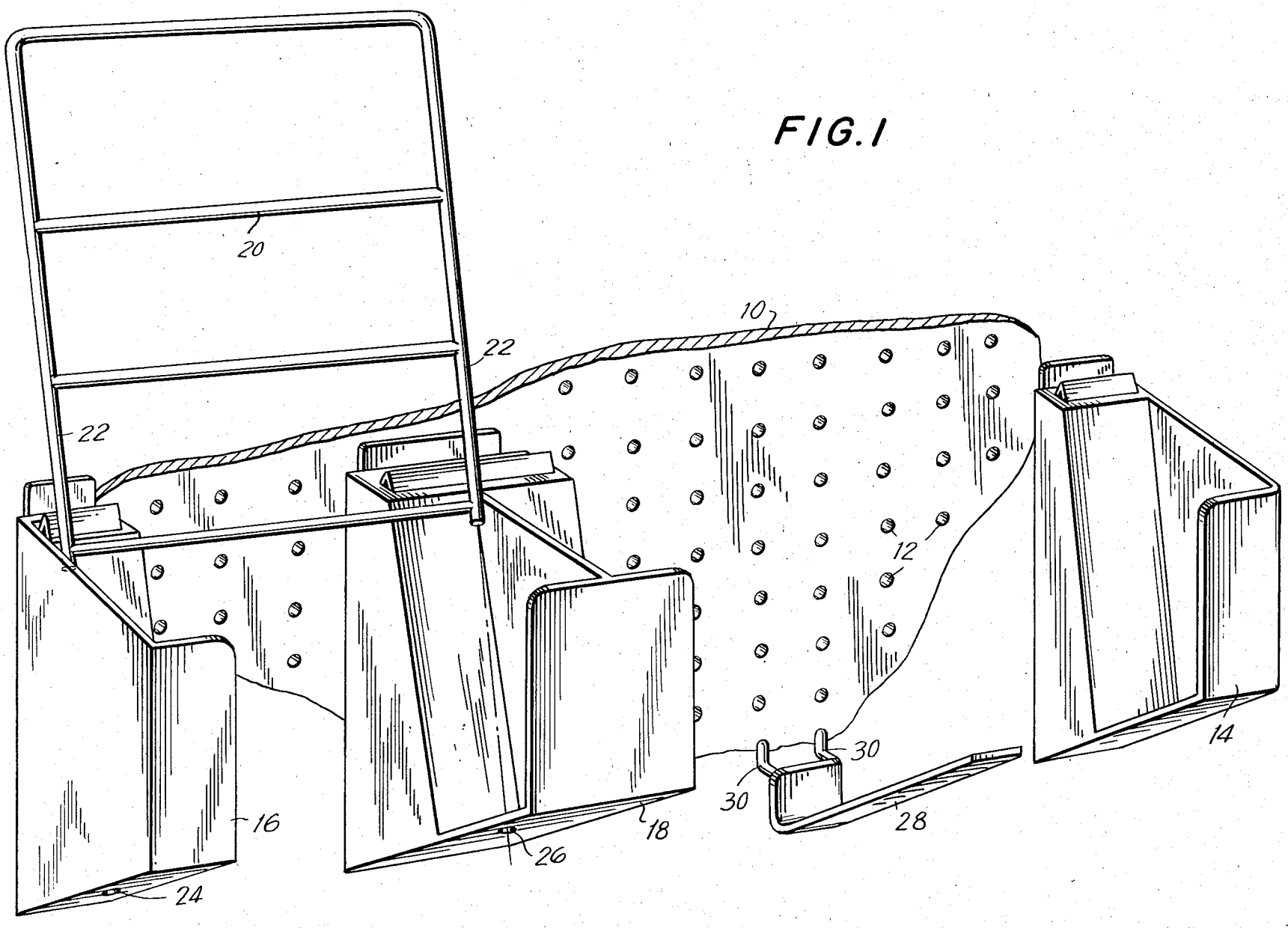
FIG. 1 is a perspective view of the adjustable article display apparatus of the present invention.

Referring now to FIG. 1, the adjustable article display apparatus of the present invention includes a carrier board 10 such as a pegboard, formed with a plurality of spaced circular-shaped openings 12. Board 10 supports a plurality of article supporting components such as a right-end support component 14, a left-end support component 16 and a middle support component 18 which has both a right-end and a left-end support component. The support components may be arranged on the board 10 to support articles of varying length so as to accommodate different size articles in a space efficient manner.

A pair of support components may also be provided with an easel 20 to support large flexible items such as magazines. Easel 20 is formed with legs 22 which are received in respective openings 24 and 26 in the support components 16 and 18. Middle support component 18 may also include further openings from which other accessories may be supported. In addition, a bridge 28 may be secured to the board 10 between two support components to provide further support for items carried therebetween. Bridge 28 is formed with a pair of L-shaped lugs 30 adapted to be received in the openings 12 of the board 10.

Figure 2:
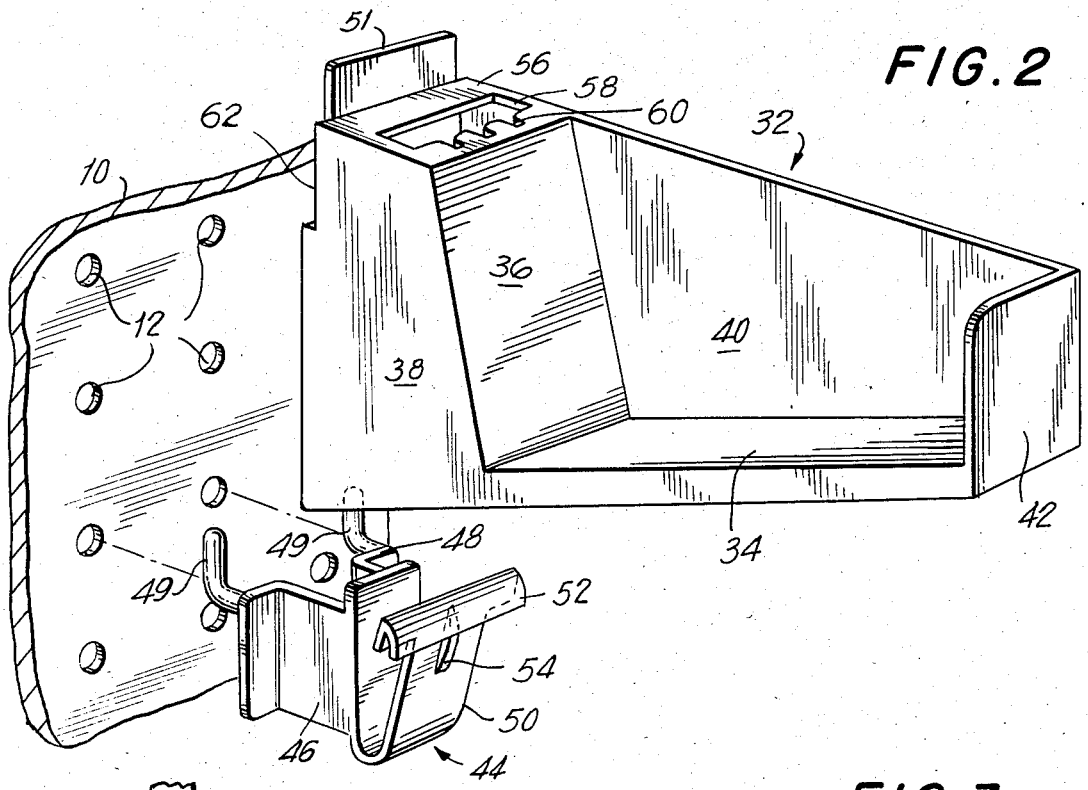
FIG. 2 is an exploded view of a right-end support component and its associated mounting bracket.
Figure 3:
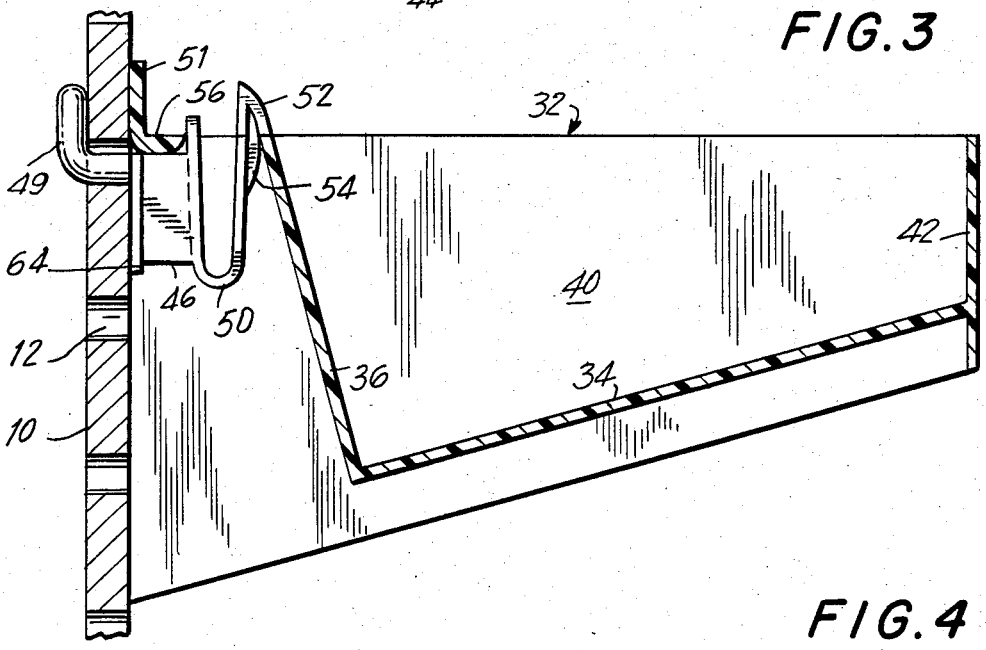
FIG. 3 is a sectional side elevation of the right-end support component and its associated mounting bracket of FIG. 2.

Referring now to FIGS. 2 and 3, a right-end support component 32 is shown. Support component 32 is formed with a deeper base than the right-end support component 14 shown in FIG. 1. It will be readily appreciated that many different variations in support component shape are possible. The right-end support component of FIG. 2, when used with a similarly shaped left-end support component, will accommodate differently shaped articles than the support components shown in FIG. 1. While many different support component shapes are possible, a few features are common to each support component and are illustrated in the support component 32 of FIG. 2.

Support component 32 is molded from any suitable material such as plastic and includes a base 34, a back wall 36, side walls 38 and 40, and a front wall 42. Base 34 extends away from the board 10 at a slight incline and back wall 36 extends upwardly from the base 34 at a slight incline. The effect of the slope of base 34 and wall 36 is to cause articles carried in the support components to be inclined towards the board 10 such that a large portion of the article is displayed for view by a customer and the article is in a stable rest position.

Support component 32 is carried on the pegboard 10 in a mounting bracket, indicated generally by the reference character 44. Mounting bracket 44 includes a pair of frame members 46 and 48 from which extend a pair of L-shaped lugs 49 adapted to be received in the openings 12 of the board 10 and to support the mounting bracket 44 and its associated support component 32 thereon. Frame members 46 and 48 terminate in a V-shaped locking member 50 formed with a tab 52 and a boss 54. Locking member 50 locks the support component 32 to its associated mounting bracket 44 in any one of several lateral positions.

To this end, support component 32 is formed with a plate 56 having an opening 58 through which tab 52 passes when the support component is secured to the mounting bracket 44. The opening 58 includes a plurality of notches 60 spaced laterally across the opening and adapted to receive the boss 54 of the mounting bracket 44. Specifically, upon mounting a support component on a mounting bracket 44, tab 52 is moved toward frame members 46 and 48 and through opening 58 of the support component 32. Tab 52 is of a generally inverted V-shaped configuration so that the support component 32 may be moved directly down over the mounting bracket 50 thereby moving the tab towards the board 10 and through the opening 58. When the tab 52 emerges from the opening 58, it is urged away from the board 10 by the lock 50 so that boss 54 engages one of the notches 60 to lock the support component onto the mounting bracket in any one of several lateral positions. It will readily be appreciated that each of the notches 60 define a discrete lateral position of the support component 32. Once the support component 32 is mounted on the mounting bracket 46, lateral adjustment may be provided by simply moving the tab 52 toward the board 10 and sliding the support component to the desired lateral position or notch 60 and then releasing the tab 52. Plate 56 of the support component 32 slides easily along frame members 46 and 48 of the mounting bracket 44.

Once the support component 32 is mounted on the mounting bracket 44, it is prevented from pivoting upwardly by the locking member 50 and by an integral stop 51. The support component is prevented from pivoting downwardly by side walls 38 and 40 which support the support component against the board 10. Inadvertent removal of the support component 32 is thereby prevented. Side walls 38 and 40 are each formed with recesses 62 and 64 to accommodate the frame members 46 and 48 of the mounting bracket 44 so that the support component will remain flush against the board 10.

Figure 4:
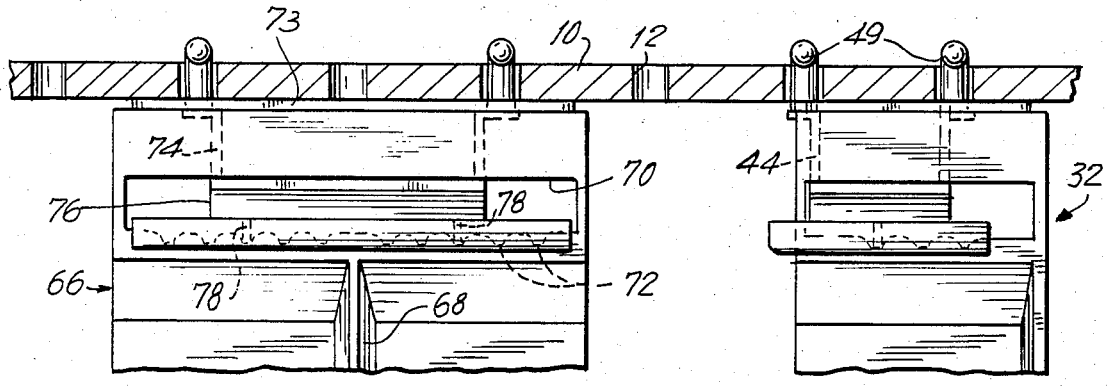
FIG. 4 is a plan view of a right-end support component and a middle support component and their associated mounting brackets with parts shown in section.

Referring now to FIG. 4, the right-end support component 32 is shown together with a middle support component, indicated generally by the reference character 66, the components cooperating to provide a display for articles. Middle support component 66 includes both a right-end support component and a left-end support component, sharing a common middle wall 68 and a common opening 70 formed with a plurality of notches 72 which permit a relatively fine lateral adjustment of the middle support component 66. The middle support component 66 is also formed with an integral stop 73 which prevents the inadvertent removal of the middle support component from the board 10. The middle support component 66 is carried on a mounting bracket 74 which is somewhat larger than the mounting bracket 44 used with the right-end support component 32. The mounting bracket 74 also includes a tab 76 which is moved towards the board 10 to adjust the lateral position of the middle support component 66. Two bosses 78 are provided for this larger mounting bracket 74.

Referring to FIGS. 5 and 6, an alternate embodiment of the adjustable article display apparatus of the invention includes support components such as a right-end support component, indicated generally by the reference character 80. Support component 80 is molded from any suitable material such as plastic, and includes a base 82, on which articles are supported, a side wall 84, a front wall 86 and a back wall 88. The support component 80 is also formed with a plate 90 from which a stud 92 extends downwardly.

Support component 80 is carried on a pegboard 94 by a mounting bracket, indicated generally by the reference character 96. The mounting bracket 96 includes a pair of L-shaped lugs 98 extending from the upper portion of the mounting bracket, which are received in circular-shaped openings 100 in the board 94. A pair of studs 102 extend from the lower portion of the mounting bracket 96 and are received in the openings 100 of the board 94. Studs 102 are split to provide a locking action after insertion into the board 94.

The mounting bracket 96 includes a platform 104 formed with a plurality of laterally-spaced circular openings 106, any one of which is adapted to receive stud 92 of support component 80. It will be readily appreciated that each of the openings 106 corresponds to a distinct lateral position of the support component 80. Platform 104 is connected to the lower portion of the mounting bracket 96 by a generally L-shaped body portion 108 which serves to angle the back wall 88 and the base 82 so that articles contained within the support component are inclined towards the board 94. The lateral position of the support component 80 may be adjusted by inserting stud 92 into the desired opening 106 on the platform 104. Thus, a precise lateral adjustment of the support component 80 is provided.

Figure 7:
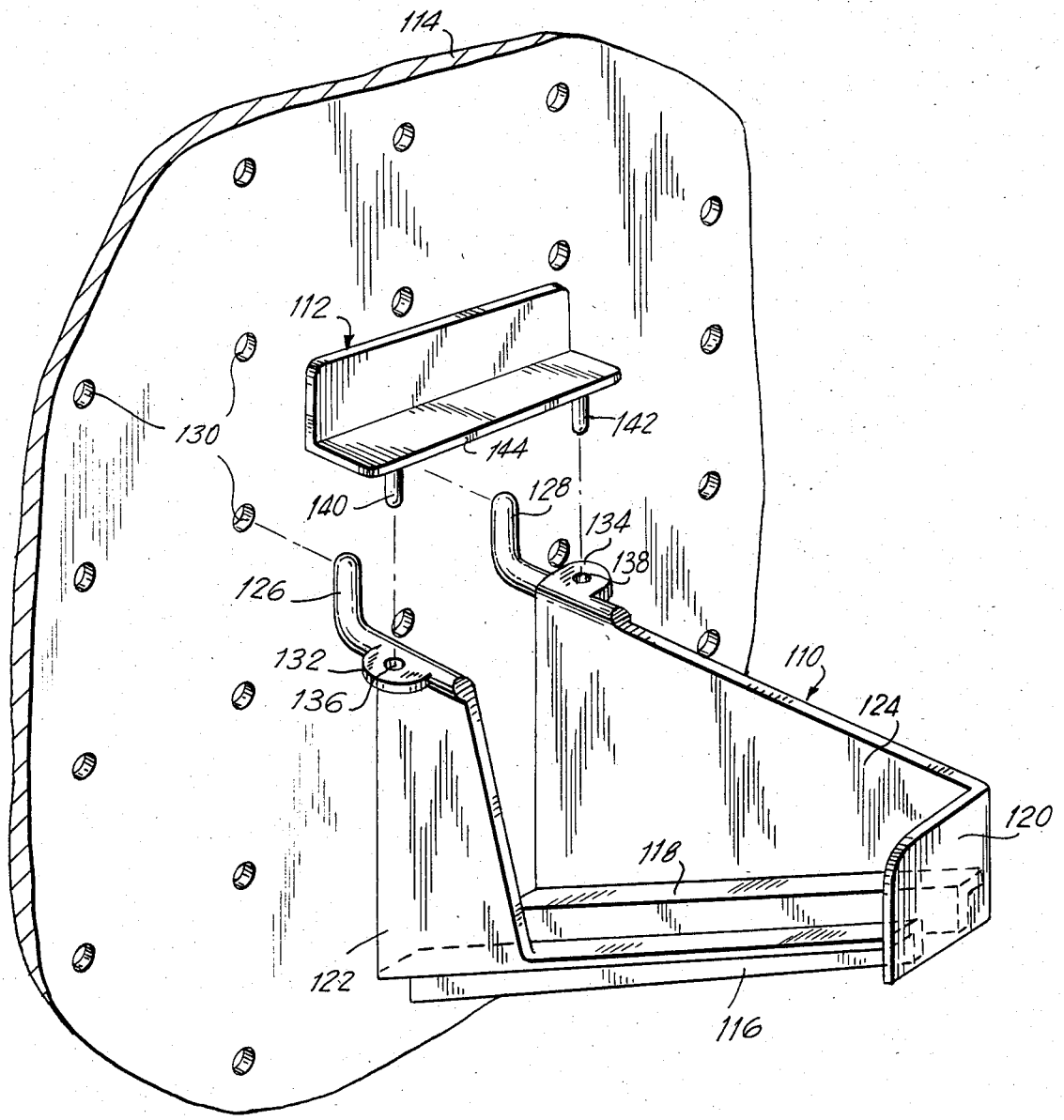
FIG. 7 is a perspective view of another alternate embodiment of the invention showing a right-end support component and its associated removable stop.

Referring now to FIG. 7, another alternate embodiment of the invention includes a right-end support component, indicated generally by reference character 110, and a generally L-shaped removable stop 112 which is received on the support component 110 to prevent the accidental removal of the support component from the board 114. The support component 110 is molded from plastic and includes a pair of base members 116 and 118 which extend away from the board 114 at a slight incline and terminate in a front wall 120. A pair of side walls 122 and 124 extend upwardly from respective base members 116 and 118 and terminate in respective L-shaped lugs 126 and 128. Lugs 126 and 128 are adapted to be received in the openings 130 of the board 114 to hold the support component 110 thereon.

Side walls 122 and 124 are also found with respective tabs 132 and 134 formed adjacent to the lugs 126 and 128. Tabs 132 and 134 are formed with respective openings 136 and 138 which receive respective studs 140 and 142 of the removable stop 112. Studs 140 and 142 extend downwardly from the base 144 of the removable stop and serve to secure it to the support component 110. With the removable stop 112 in place, the support component 110 is locked to the board 114 and will not be easily dismounted from the board. The removable stop 112 prevents the support component 110 from pivoting on its lugs 126 and 128 in response to the exertion of an upward force on the underside of the support component and thereby guards against the accidental removal of the support component from the board 114. The removable stop 112 may be removed from the support component 110 for normal installation and removal of the support component on the board 114.

Figure 8:
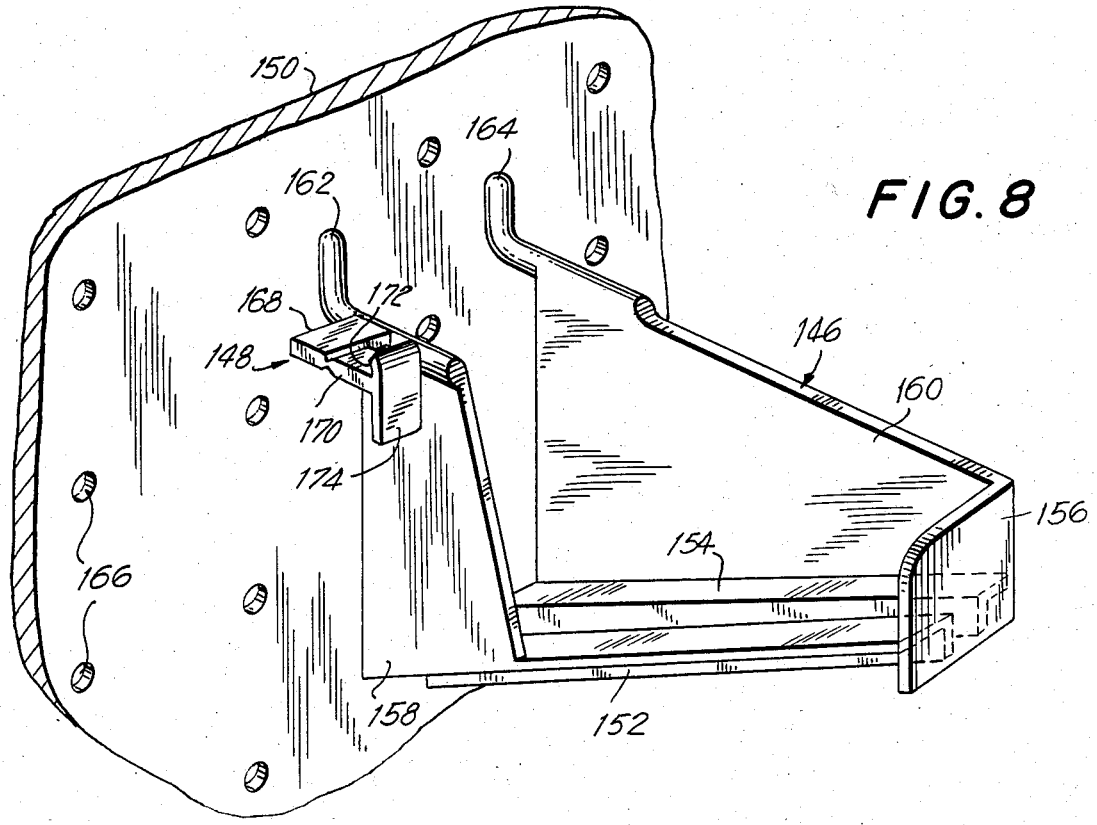
FIG. 8 is a perspective view of another alternate embodiment of the invention showing a right-end support component.
Figure 9:
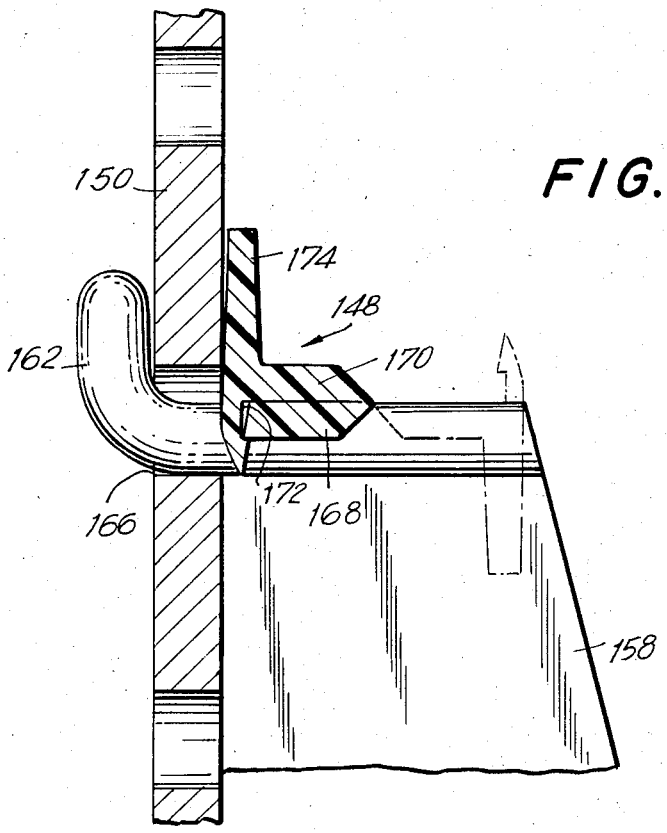
FIG. 9 is a fragmentary side elevation of the right-end support component of FIG. 8.

Referring to FIGS. 8 and 9, another alternate embodiment of the invention includes a right-end support component indicated generally by the reference character 146, formed with a hinged stop 148 which prevents the accidental removal of the support component from a carrier board 150. The support component 146 is molded from plastic and includes a pair of base members 152 and 154 which extend away from the board 150 at a slight incline and terminate in a front wall 156. A pair of side walls 158 and 160 extend upwardly from respective base members 152 and terminate in respective L-shaped lugs 162 and 164. Lugs 162 and 164 are received in the openings 166 of the board 150 to hold the support component 146 thereon.

The hinged stop 148 is formed from a platform 168 which extends outwardly from wall 158 such that the platform forms a right angle with the side wall. Platform 168 is hinged to a T-shaped arm 170 which is movable between a first or unlocked position, as shown in FIG. 8, and a second or locked position, as shown in FIG. 9. Arm 170 is formed with a recess 172 and a stopping member 174. When the arm 170 is in its first position, the support component 146 may be easily installed and removed from the board 150. When the arm is in its second position, recess 172 receives the end of the platform 168, which is remote from the arm 170 in its first position, to lock the arm in its second position. In this locked position, stopping member 174 abuts the board 150 to prevent the accidental removal of the support component 146 from the carrier board 150. The hinge lock 148 prevents the support component 146 from pivoting on its lugs 162 and 164 in response to the exertion of an upward force on the underside of the support component thereby locking the support component to the board 150.

Figure 10:
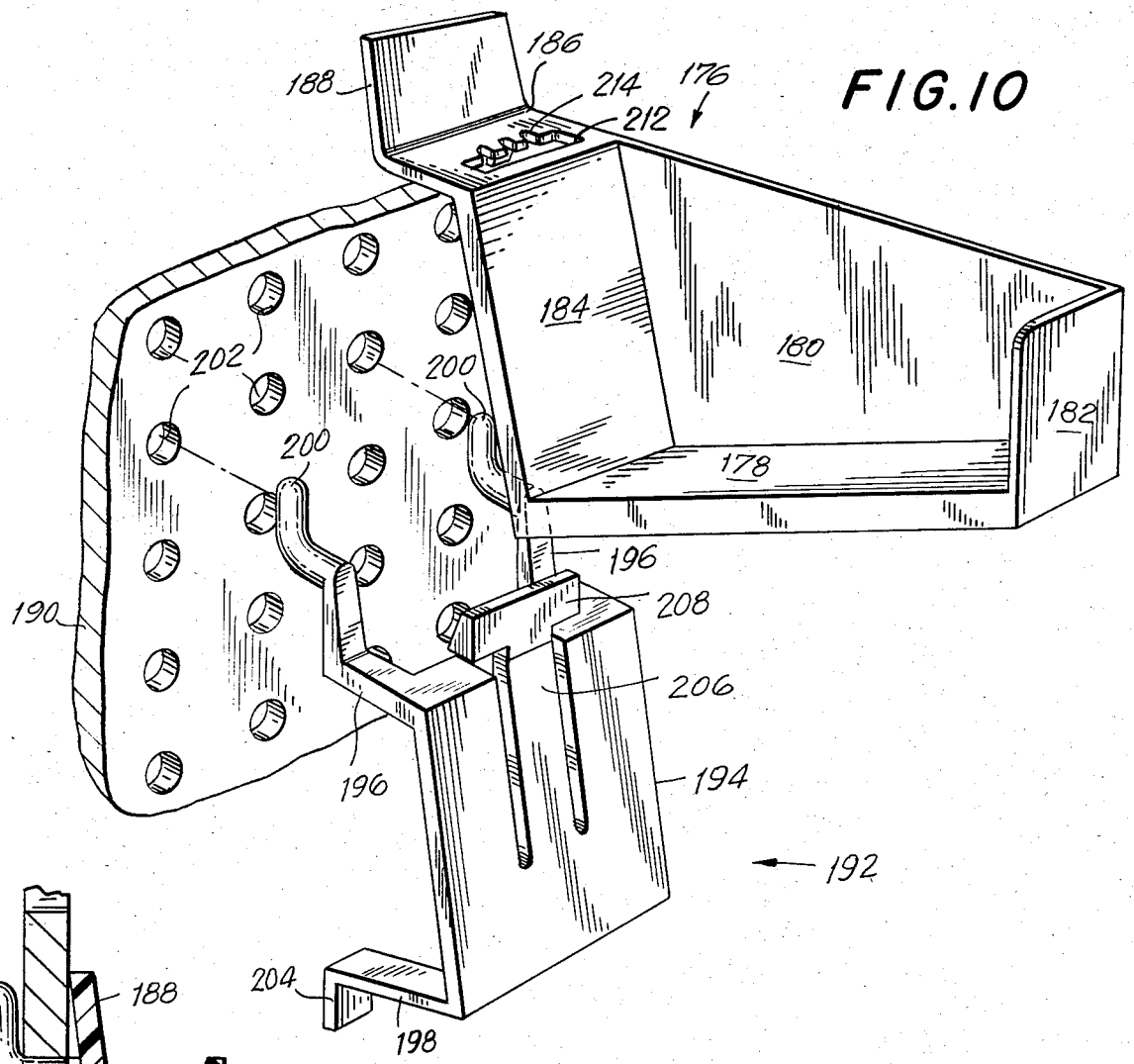
FIG. 10 is an exploded view of another alternate embodiment of the invention showing a right-end support component and its associated mounting bracket.
Figure 11:
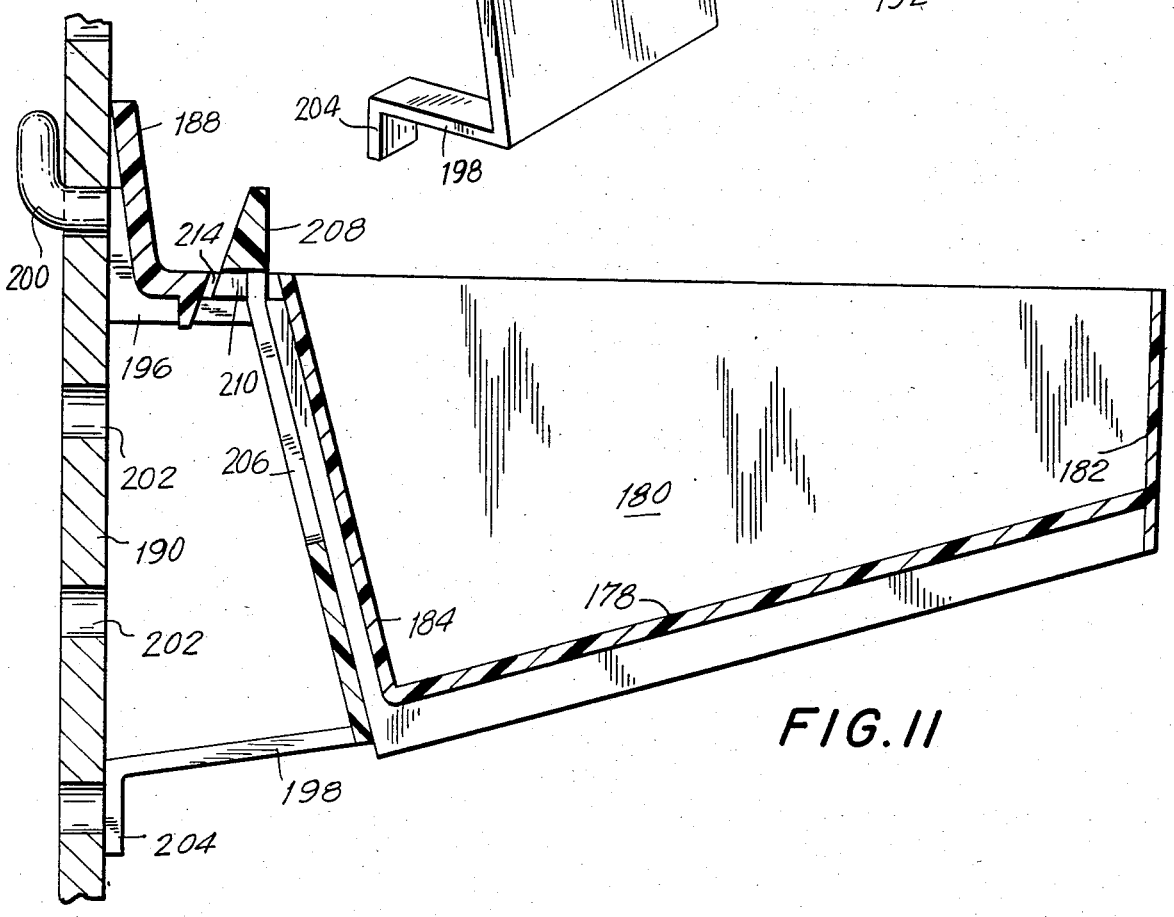
FIG. 11 is a sectional side elevation of the right-end support component and its associated mounting bracket.

Referring now to FIGS. 10 and 11, another alternative embodiment of the adjustable article display apparatus of the invention includes support components such as a right-end support component, indicated generally by the reference character 176. Support component 176 is molded from any suitable material, such as plastic, and includes a base 178 on which articles are supported, a side wall 180, a front wall 182 and a back wall 184. The support component 176 is also formed with a plate 186 from which a stop 188 extends upwardly.

Support component 176 is carried on a pegboard 190 by a mounting bracket, indicated generally by the reference character 192. The mounting bracket 192 includes a body 194 on which the support component 176 is supported, a pair of arms 196 and a pair of legs 198. Each of the arms 196 terminates in L-shaped lugs 200 which are received in circular-shaped openings 202 in the board 190. Each of the legs 198 terminates in feet 204 which stand on the board 190. Arms 196 and legs 198 serve to secure the mounting bracket 192 to the board 190.

Body 194 is also formed with a locking member 206 formed with a tab 208 and a boss 210. Locking member 206 is normally biased toward the board 190 and serves to lock support component 176 to its associated mounting bracket 192 in any one of several lateral positions.

To this end, support component 176 is formed with an opening 212 in plate 186, through which opening tab 208 passes when the support component 176 is secured in the mounting bracket 192. The opening 212 includes a plurality of notches 214 spaced laterally across the opening and adapted to receive boss 210 of the mounting bracket 192. Specifically, upon mounting support component 176 to mounting bracket 192, tab 208 is moved away from board 190 and through opening 212 of the support component 176. When the tab 208 emerges from the opening, it is urged toward the board 190 by locking member 206 so that boss 210 engages one of the notches 214 to lock the support component 176 on to the mounting bracket 192. It will readily be appreciated that each of the notches 212 define a discrete lateral position of the support component 176. Once the support component 176 is mounted on the mounting bracket 192, lateral adjustment may be provided by simply moving the tab 208 away from the board 190 and sliding the support component 176 to the desired lateral position (notch 214) and then releasing the tab 52.

Once the support component 176 is mounted on the mounting bracket 192, it is prevented from pivoting upwardly by the locking member 206 and the integral stop 188. Locking member 206 also prevents the support component 176 from pivoting downwardly. Inadvertent removal of the support component 176 is thereby prevented.

As will be readily apparent to those skilled in the art, the invention may be used in other specific forms or for other purposes without departing from its spirit or central characteristics. The present embodiments are therefore to be considered as illustrative and not restrictive, the scope of the invention being indicated by the claims rather than by the foregoing description, and all embodiments which come within the range of equivalence of the claims are intended to be embraced.

What is claimed is:

1. Article Display Apparatus for use with a carrier board including in combination a plurality of mounting brackets each having a lug means for detachably affixing said mounting bracket to said carrier board, a plurality of support components, each adapted to be carried on a mounting bracket in any one of a plurality of lateral positions, said support components cooperating to support at least one article, means for releasably locking each support component on a mounting bracket on one of said lateral positions, thereby permitting said adjustments of the lateral spacing of such support components, said means for releasably locking each support component on a mounting bracket in a plurality of positions comprises a plurality of laterally spaced notches formed in said support component, a boss carried on said mounting bracket and means for resiliently urging said boss into any of said notches.

* * * * *